United States Patent [19]

Pecz et al.

[11] Patent Number: 4,481,783

[45] Date of Patent: Nov. 13, 1984

[54] HYBRID HEAT PUMP

[75] Inventors: Péter Pecz, Dunaujváros; Géza Hivessy, Budapest, both of Hungary

[73] Assignee: Energiagazdalkodasi Intezet, Budapest, Hungary

[21] Appl. No.: 440,529

[22] Filed: Nov. 10, 1982

Related U.S. Application Data

[63] Continuation of Ser. No. 157,422, Jun. 9, 1980, abandoned.

[30] Foreign Application Priority Data

Jun. 8, 1979 [HU] Hungary ..... PE 1086

[51] Int. Cl.[3] ..... F25B 15/00

[52] U.S. Cl. ..... 62/101; 62/115; 62/335; 62/476

[58] Field of Search ..... 62/335, 101, 476, 502, 62/115

[56] References Cited

U.S. PATENT DOCUMENTS

| | | | |
|---|---|---|---|
| 2,307,380 | 1/1943 | Baker | 62/101 |
| 2,581,558 | 1/1952 | Ruhemann . | |
| 2,952,139 | 9/1960 | Kennedy et al. . | |
| 3,067,590 | 12/1962 | Wood, Jr. | 62/335 |
| 3,203,194 | 8/1965 | Fuderer | 62/502 X |
| 3,283,524 | 11/1966 | Byron | 62/115 |
| 3,872,682 | 3/1975 | Shook | 62/502 X |
| 3,922,873 | 12/1975 | Leonard | 62/476 |
| 3,952,533 | 4/1976 | Johnston | 62/115 |
| 3,990,264 | 11/1976 | Patnode et al. | 62/476 |

FOREIGN PATENT DOCUMENTS

| | | |
|---|---|---|
| 142330 | of 0000 | Fed. Rep. of Germany . |
| 84084 | of 0000 | Fed. Rep. of Germany . |
| 953378 | of 0000 | Fed. Rep. of Germany . |
| 2538730 | of 0000 | Fed. Rep. of Germany . |
| 2624714 | of 0000 | Fed. Rep. of Germany . |
| 386863 | of 0000 | Fed. Rep. of Germany . |
| 1125956 | 3/1962 | Fed. Rep. of Germany . |
| 537438 | of 0000 | France . |

*Primary Examiner*—Lloyd L. King

*Attorney, Agent, or Firm*—Handal & Morofsky

[57] ABSTRACT

The invention relates to a heat pump with compressor, in the thermodynamic system of which, solution is used. This way varying temperature conditions take place on the heat intake and heat discharge side. Provided that varying temperature system appears also on the demand side, adapting the heat pump of the invention accordingly, the specific cooling capacity may be several times that of the traditional cooling machines under identical temperature parameters.

The "wet compression" worked out in the invention, results in further increase of the specific cooling capacity, as well as it makes the competetiveness of the heat pump according to the invention indisputable in such field as for instance deep freezing.

5 Claims, 4 Drawing Figures

HYBRID HEAT PUMP

This application is a continuation of application Ser. No. 157422, filed June 9/80, now abandoned.

FIELD AND BACKGROUND OF THE INVENTION

The invention relates to a heat pump with compressor, the thermodynamic system of which contains solutions already known, or similar to those used in the absorption cooling machines.

The application possibilities of the heat pumps, increase of their efficiency as a result of the energy crisis are studied with redoubled intensity all over the world. Actually the heat pump is a cooling machine of reversed function, which lifts over the energy of the surroundings into a functionally closed space.

The presently known heat pumps function with cooling media generally known in the cooling technique. The directions of research point toward the refinement of the solutions fully developed in the cooling technique, and toward their adaptation to the heat pumps. However no significant breakthrough can be expected from this line of research.

There are such cooling tasks, when a medium of varying temperature has to be cooled and the extracted energy is to be transmitted to a medium of varying temperature /e.g. cooling water/.

In this case the traditional cooling machines have a great disadvantage in that it is necessary to go below the lowest temperature of the medium to be cooled on the heat extraction side, and to exceed the highest temperature of the heat extracting medium on the heat dissipation side with the evaporation and condensation temperatures of the cooling machine, and in close connection with this the pressure of the heat exchange vessels has to be determined between unnecessarily high limits. Thus also the value of the pressure ratio fundamentally determinative for the compressor's operation will be unfavorable. The same problem exists at the heat pumps as well.

This adverse phenomenon is eliminated by the cooling machine according to the invention or by the heat pump functioning on the same principle.

SUMMARY OF THE INVENTION

The gist of the invention and, at the same time, the task to be solved with the invention were to develop a hybrid machine embracing the advantageous properties of the absorption and compressor-type cooling machines, without possessing their unfavourable properties.

In the interest of solving the set objective, the heat exchange vessel of varying temperature made possibly by the absorption principle was combined with the compressor of the compressor-type machines, accordingly not pure cooling medium, but solutions known in connection with the absorption (or resorption) cooling machines, or similarly composed solutions are circulated as working medium in the thermodynamic cycle of the equipment according to the invention. Thus under working medium one should understand a medium containing two components, namely, the cooling medium or refrigerant and an absorbent.

Thus the set objective is solved by providing at least one of the heat exchange vessels in the compressor system and circulating the absorption solution and ensuring the heat exchange with the surroundings and making it of a tubular or laminar so-called "dry system" construction, which ensures continuously varying concentration conditions along the heat exchange surface in respect of both phases of the working medium between the initial and final state, as well as the concomitant continuously varying temperature conditions.

According to another embodiment of the invention the vapor and liquid phase of the working medium are present in the working space of the compressor together and, at the same time, during the working stroke.

According to a preferable embodiment of the invention a phase separator is built in after the evaporator. Similarly according to a preferable embodiment a rectifier is built into the vapor phase conduit of the working medium after the phase separator.

According to a further suitable embodiment of the invention a phase separator is placed after the compressor and an after-cooler is built in after the condenser, as well as the internal heat exchanger, where the two parallel, separate cooling medium circuits have at least one common section. At this embodiment it is advisable to build in a rectifier after the phase separator and before the condenser to increase the cooling medium-concentration ot the vapor phase.

According to another suitable embodiment of the invention a driving circle consisting of boiler, expansion engine, absorber, internal heat exchanger and solution pump, is connected to the basic equipment, in which the expansion engine and compressor of the basic equipment are connedted with each other through a power transmitting device.

The utilisation factor $\epsilon$ of the heat pump according to the invention—in case of identical pressure conditions—is somewhat smaller than that with the traditional one, but in case of identical temperature gap the heat pump according to the invention is capable to produce a 1.5–2 times greater utilisation factor.

With target-oriented research and with the use of the media of higher specific solution heat, this value can be considerably increased.

BRIEF DESCRIPTION OF THE DRAWINGS

The invention is described in detail with reference to the enclosed drawings illustrating the various possible connection diagrams of the hybrid heat pump according to the invention, in which FIG. 1 basic connection of the hybrid heat pump.

DESCRIPTION OF THE PREFERRED EMBODIMENTS

Figure 1:
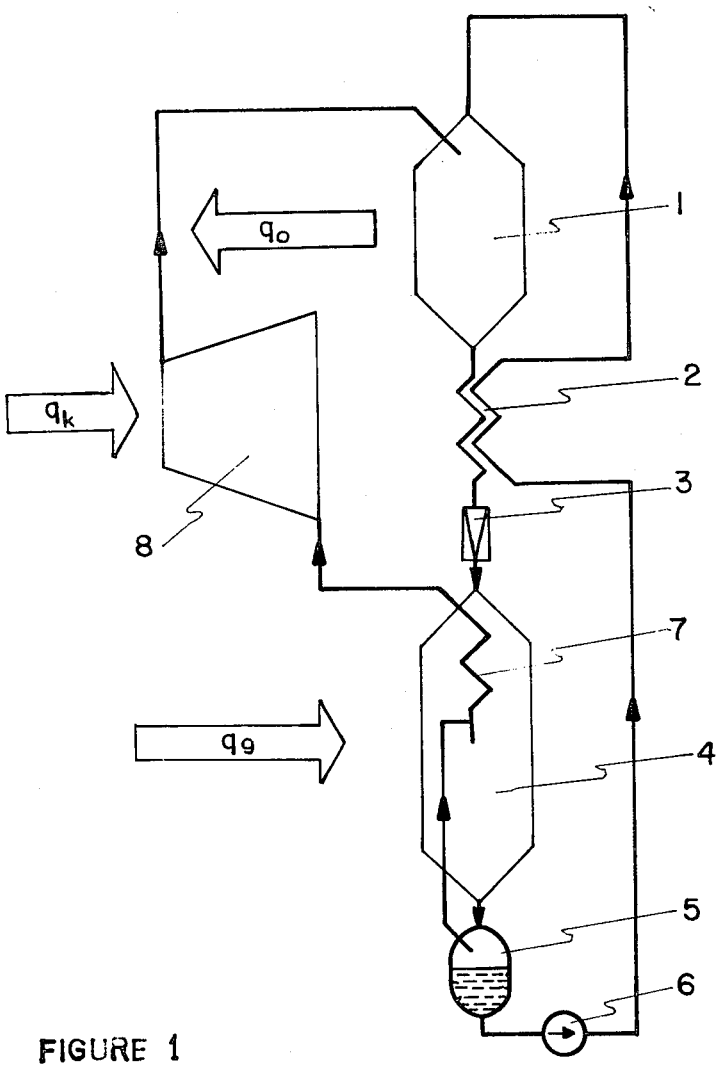

FIG. 1 shows the basic type of the hybrid heat pump according to the invention. From the diagram it is apparent, that the equipment circulating a solution in its thermodynamic system, is provided with absorber 1 and evaporator 4, called by the common name as heat exchange vessels. The internal heat exchanger 2 and pressure reducing valve 3 (suitably a choke valve) are arranged between the absorber 1 and evaporator 4, while the phase separator 5 is behind the evaporator 4, where the two-phase solution is separated. Path of the liquid returns into the absorber 1 through the internal heat exchanger with the aid of the liquid pump 6. Conduit of the vapor phase leads through the rectifier 7 to compressor 8, the outlet of which is connected with the absorber.

Mode of operation of the equipment is the following:

Absorption solution of low pressure passes into the evaporator 4 after flowing through the pressure reducing valve 3, which evaporator 4 extracts the heat from the medium to be cooled. The amount of heat $q_g$ extracted from the medium to be cooled carries a significant part of the cooling medium or refrigerant component of the solution into the vapor phase, thereby expelling the cooling medium from the solution and supplying the necessary heat for dissolution and evaporation.

A two-phase flow is brought about in the evaporator 4, while the proportion of vapor phase along the heat exchanger's surface constantly increases. With this, the temperature of the flow system rises in accordance with the rules of the solutions.

The two-phase mixture emerging from the evaporator 4 passes into the phase separator 5, where the liquid and vapor phase are separated. From here the liquid passes into the absorber 1 through the internal heat exchanger 2 with the aid of the liquid pump 6, where it is connected again with the steam phase.

The steam phase passes through the rectifier 7 into the compressor 8, which compresses the vapor phase to the higher pressure of the absorber 1 with use of mechanical work $q_k$.

Mixing of the vapor phase and liquid containing a small amount of cooling medium, i.e. the so-called poor solution, furthermore dissolution of the cooling medium in the solvent, the heat evaporation and dissolution, i.e. extraction of the heat $q_o$, at varying parameters take place in the absorber 1. Applying the construction principles already stated in case of the evaporator 4, the varying temperature range is definitely applicable for the heat exchanging surface, thus the heat loss is indeed utilizable at varying temperature parameters.

Use of the internal heat exchanger 2 improves the thermal efficiency of the equipment.

Figure 2:
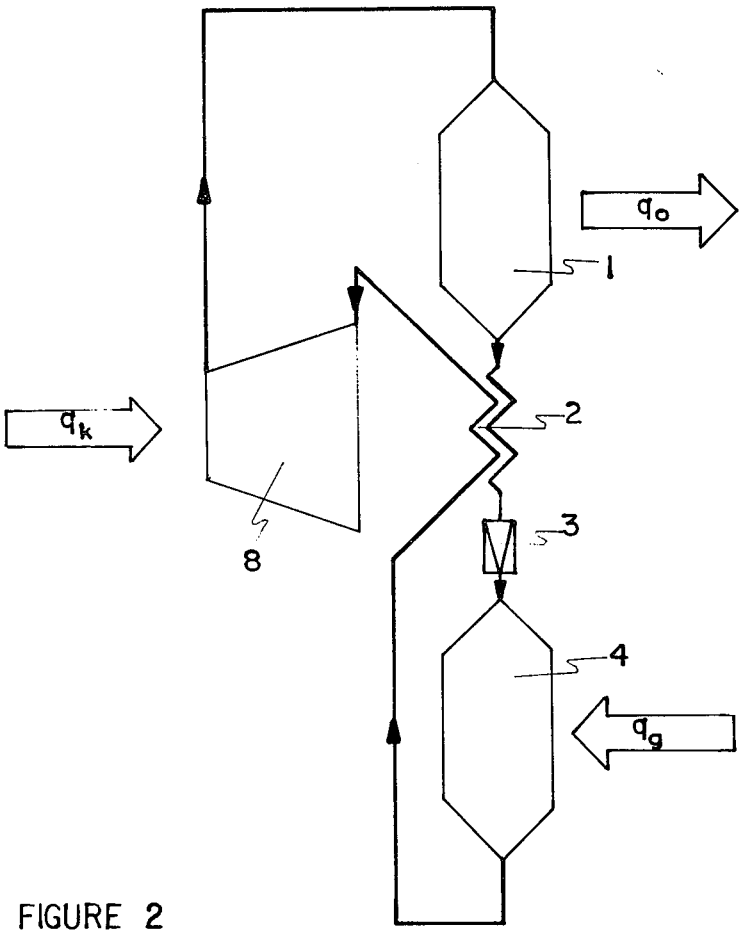
FIG. 2 illustrates a connection diagram of the hybrid heat pump realizing the so-called "wet compression"

Another suitable embodiment of the hybrid heat pump according to the invention is shown in FIG. 2. This embodiment differs from the one described above by the phases of the two-phase working medium emerging from the evaporator 4 not being separated, but they pass jointly and simultaneously into the working space of the compressor, where besides the compressing it is possible to bring about the physical processes determined by the thermodynamics of the solutions.

Besides the vapor phase the liquid may be present in two different forms. Such method is also conceivable when the liquid phase occurs in its commonly known form, but presence of the liquid in the form of aerosol is also possible. In the latter case the pump and evaporator are naturally necessary for solving the problem.

The high pressure liquid and steam mixture passes from the compressor 8 into the absorber 1, where extraction of the evaporation heat of the steam phase and solution heat $q_o$ of the cooling medium at varying temperature and its utilization for heating take place.

The high pressure liquid after the internal heat exchanger 2—which is aimed at increasing the energy efficiency—passes into the pressure reducer 3, where expansion of the working medium takes place.

The expanded and thus cooled medium passes into the evaporator 4, where the heat $q_g$ of the medium to be cooled is admitted into the system. The admitted heat expels the cooling medium from the solution, thus again a two-phase system will develop at the end of the evaporator. This medium comprising the liquid and vapor then passes into the compressor 8.

The great advantage of this embodiment is the so-called "wet compression". Mixing of the vapor and liquid phase during the compression takes place parallel with the pressure rise of the dissolution, and the vapor phase in function of the time and reaction velocities, as well as the liquid phase aim at thermic equilibrium from point to point until it is accomplished in accordance with the thermodynamic rules governing these solutions. However the temperature values pertaining to these equilibriums are always considerably lower, than the temperature values pertaining to the given pressure in case of adiabatic compression.

Thus in respect of the vapor phase the situation can be regarded as if a constant and continuous recooling process would take place parallel with the compression. The significance of this phenomenon from the energy viewpoint is well-known by the experts. Further compression work reducing effect is,that the mass proportion of the vapor phase too will decrease, thus the condensation of lower amount of vapor will be necessary.

In addition to the described phenomenon, the final temperature of the compression drops just as well, which is of decisive significance in respect of the construction characteristics of the compressor, and applicable materials. Pressure condition of the single-stage compression may considerably increase, thus the set objective is realizable with simpler and less expensive equipment.

These characteristics of the embodiment in contrast with the one described earlier, exhibit such properties, which promise more favourable results.

Figure 3:
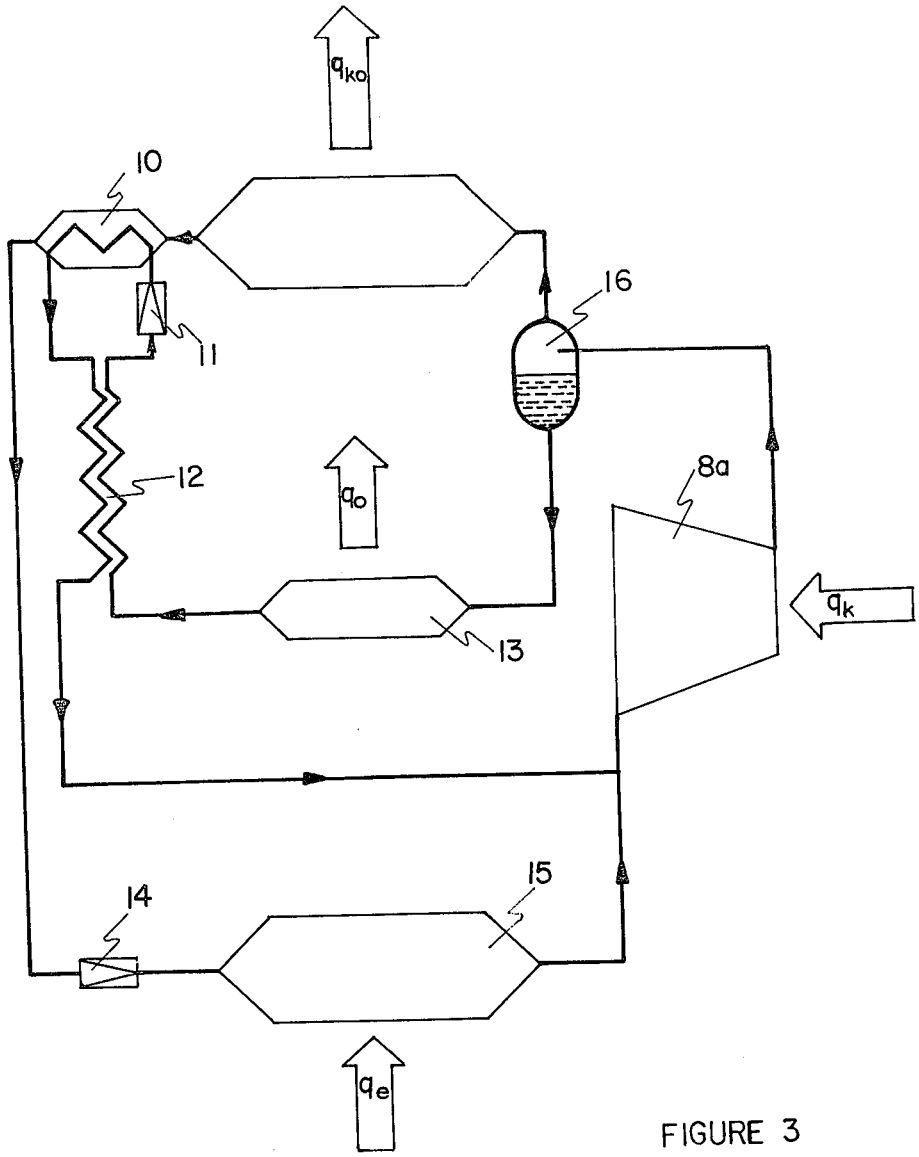
FIG. 3 illustrates a further possible embodiment of the heat pump according to the invention, particularly suitable for deep freezing.

A further embodiment of the heat pump according to the invention is shown in FIG. 3.

This embodiment is applicable in cases when use of a heat exchanger of constant or nearly constant temperature is preferable in the heat exchange with the surroundings either on the low or high pressure side, or at both pressures at the same time. This latter case—shown in the diagram— may be regarded actually as a further development of the traditional cooling machine.

Thus the machine according to the embodiment combines the advantages of the heat exchanger of constant temperature and those given by the thermodynamics of the solutions materialized in the wet compression.

The high-pressure, two-phase working medium emerging from the compressor 8 passes into the phase separator 16, where the path of the liquid and vapor separates from each other.

Thereafter the vapor passes into a conventional condenser 9 in which it dissipates its evaporation heat, then it passes through the after-cooler 10 and pressure reducer 14 into the evaporator 15, where the heat extraction from the surroundings takes place at constant temperature, entailing the evaporation of the working medium as well.

The liquid passes from the phase separator 16 into the liquid cooler 13, where it is liberated from its heat content still useable or physically extractable in the cooling machine operation.

In the next step the liquid flows through the internal heat exchanger 12 and pressure reducer 11 into the after-cooler, where after-cooling of the liquid cooling medium is carried out. From here passing through the other side of the internal heat exchanger 12, it flows to the intake side of the compressor 8, where it is mixed with the vapor derived from the evaporator.

Then the compressor 6 forwards the mixture again into the phase separator 16.

This embodiment is favourably used first of all in case of cooling tasks requiring high pressure difference/deep freezing, heating with heat pump/, but even in case of traditional cooling conditions energy improvements can be expected.

Figure 4:
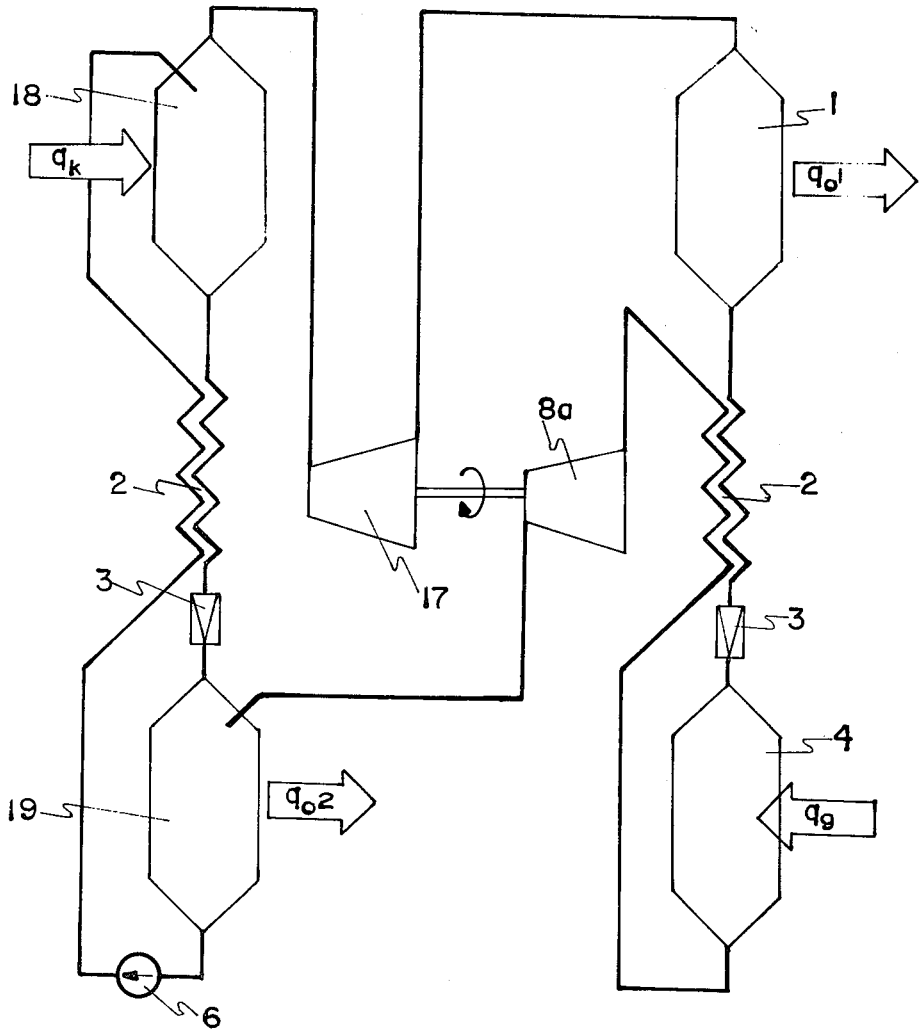
FIG. 4 illustrates a further suitable heat pump embodiment.

Advantage of the embodiment shown in FIG. 4 is, that it combines the good properties of the embodiments described earlier and those of the absorption machines, since this embodiment functions with the use of thermal energy without using external mechanical energy.

The inalienable advantage of the machine according to this embodiment in relation to the resorption cooling machine is found in the fact, that very high temperature difference can be embraced between the heat exchangers, in other words the machine according to the embodiment has twice as much specific working capacity utilisation factor $\epsilon$ under identical external, ambient conditions as the heat pumps of traditional system.

The liquid working medium passes from the absorber 1 in the way already known through the heat exchanger 2 and pressure reducer 3 into the evaporator 4, where it takes up thermal energy $q_g$ from the surroundings, as a result of which part of it evaporates.

The remaining liquid or vapor phase passes into the compressor 8 where the "wet compression" takes place.

The compressor 8 forces the working medium into the absorber 19 of the driving side. Here the working medium is absorbed by the poor solution of low concentration coming from the boiler 18, dissipating its evaporation and solution heat $q_{02}$.

The rich solution passes from the absorber 19 with the aid of solution pump 6 through the internal heat exchanger 2 into the boiler 18, from where the vapor rich in cooling medium is repeatedly expelled with the external $q_{ka}$ at high temperature level.

The poor solution returns through the heat exchanger 2 and pressure reducer 3 into the absorber 19 on the driving side.

The vapor leaving the boiler 18 passes into an expansion engine 17, in which part of its enthalpy is converted to mechanical energy. This mechanical energy drives the compressor 8.

The vapor as the working medium leaving the expansion engine 17 passes into the absorber 1, whereby the thermodynamic cycle is closed.

At this embodiment it is necessary to mention that the working medium emerging from the compressor 8 could be conducted also into the absorber 1, and the vapor emerging from the expansion engine 17 ought to be directed into the absorber 19 on the driving side. This way the working and driving side would be thermodynamically separated. However this kind of connection mode is indifferent, since it yields no further advantages functionally, on the contrary it would result in the deterioration of the specific characteristics. Its reason being that with the reasonable selection of the concentration conditions of the driving side, higher temperatures can be reached in the absorber 19, which is essential, since this way a higher proprotion of the energy is obtained at higher temperature level. Namely after the compressor, the sum of the heat admitted into the evaporator shall be extracted.

In summing up it must be laid down, that the heat pump according to the invention has a very wide range of application, because from the deep freezing tasks up to heating operation mode it offers from the energy viewpoint a more favourable operation for the user, then any of the present machines.

Further advantage of the machine is, that as a function of the applied solution concentration conditions the machine is flexibly adaptable to the tasks to be solved, and optimalization of the operating characteristics is given.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. Hybrid compression-absorption method for operating heat pumps or refrigeration machines, with a working medium consisting of a solvent and a refrigerant soluble therein, in which in a first heat-exchange action, the refrigerant is dissolved in the solvent, heat being withdrawn, and after expansion of the working medium removed from the first heat-exchange action as liquid phase consisting of the solvent and the refrigerant dissolved therein, heat is supplied to this medium in a second heat-exchange action and thus the refrigerant dissolved in the solvent is at least partially expelled as vapour phase, and in a compression action the vapour phase of the working medium withdrawn from the second heat-exchange action is compressed, the concentration of the refrigerant in the liquid phase of the working medium being continuously varied along the path of the working medium through the second heat exchange action, characterized in that by the supply of heat in the second heat-exchange action the solvent is also partially evaporated, in that along the path of the working medium through the second heat-exchange action, preferably also through the first heat-exchange action, the concentration of the refrigerant in the vapour phase of the working medium too is varied continuously, simultaneously and in common with that of the liquid phase, and in that the vapour phase and the liquid phase of the working medium, which are withdrawn from the second heat-exchange action, are subjected simultaneously and in common to the compression action.

2. Method according to claim 1, characterized in that the working medium withdrawn from the first heat-exchange action is brought before the compression action in counter-current into interior heat-exchange with the working medium before the expansion.

3. Method according to claim 1, characterized in that the working medium withdrawn from the compression action is mixed in a third heat-exchange action, heat being withdrawn, with a solution poor in refrigerant and thus its vapour phase is condensed and the refrigerant thereof is absorbed, in that then in a fourth heat-exchange action by supply of heat the refrigerant is expelled and a part of the solvent is evaporated out of the refrigerant-rich solution withdrawn from the third heat exchange action, in that the consequent refrigerant-poor solution is brought into heat exchange with the refrigerant-rich solution withdrawn from the third heat-exchange action and thereafter expanded and returned into the third heat-exchange action, and in that the refrigerant and solvent vapour withdrawn from the fourth heat-exchange action is expanded, mechanical energy being generated which is used as drive energy of the compression action, and returned into the first heat-exchange action.

4. Hybrid refrigeration machine or heat pump, having a working medium cycle which contains an absorber (1), a gas extractor (4) connected by way of an expansion valve (3) after the absorber, and a mechanical compressor (8) placed after the gas extractor, characterized in that the absorber (1) and the gas extractor (4) are formed as heat exchangers of such kind that, due to their design, between their entry and exit a constrained path for the working medium formed by guide elements and common to the liquid phase and the vapour phase of the working medium is brought about in that between the absorber (1) and the expansion valve (3) on the one hand and between the gas extractor (4) and the compressor (8) on the other an inner counter-current heat exchanger (2) is placed, and in that the exit of the gas extractor (4) is connected by way of the inner heat exchanger (2) to the compressor (8) without conduit branching.

5. Hybrid refrigeration machine or heat pump according to claim 5, characterized in that the exit of the compressor (8) is connected to an absorber (19) of a drive cycle which comprises a boiler (18) following its absorber (19), which boiler is connected on the liquid phase side through a second expansion valve (3) to the absorber (19) of the drive cycle and on the vapour side through a mechanical expansion machine (17), which is coupled with the compressor (8) as its drive, to the absorber (1) of the working medium cycle, while an inner heat exchanger (2) is interposed between the boiler (18) and the expansion valve (3) of the drive cycle on the one hand, and its absorber (19) and the boiler (18) on the other hand.

* * * * *